US009963807B2

(12) United States Patent
Xia et al.

(10) Patent No.: US 9,963,807 B2
(45) Date of Patent: May 8, 2018

(54) METHOD AND APPARATUS FOR PNEUMATIC GUIDING AND CAPTURING STRAND FIBERS ON RING FRAME

(71) Applicant: Wuhan Textile University, Wuhan, Hubei (CN)

(72) Inventors: Zhigang Xia, Hubei (CN); Weilin Xu, Hubei (CN); Wenxiang Ye, Hubei (CN); Genyang Cao, Hubei (CN)

(73) Assignee: Wuhan Textile University, Wuhan, Hubei (CN)

( * ) Notice: Subject to any disclaimer, the term of this patent is extended or adjusted under 35 U.S.C. 154(b) by 356 days.

(21) Appl. No.: 14/803,140

(22) Filed: Jul. 20, 2015

(65) Prior Publication Data

US 2015/0322594 A1 Nov. 12, 2015

(30) Foreign Application Priority Data

Mar. 4, 2015 (CN) ..... 2015 1 0095954

(51) Int. Cl.
*D01H 5/72* (2006.01)
*D01H 1/02* (2006.01)
*D01H 1/24* (2006.01)

(52) U.S. Cl.
CPC ..... *D01H 5/72* (2013.01); *D01H 1/025* (2013.01); *D01H 1/24* (2013.01)

(58) Field of Classification Search
CPC ..... D01H 5/72; D01H 1/025
See application file for complete search history.

(56) References Cited

U.S. PATENT DOCUMENTS 3,387,339 A * 6/1968 Bofill ..... D01H 5/72 19/150
4,488,397 A * 12/1984 Venot ..... D01H 5/72 57/287
5,761,773 A * 6/1998 Nauthe ..... D01H 5/72 19/150
5,829,101 A * 11/1998 Denz ..... D01H 5/72 19/157
6,332,311 B1 * 12/2001 Todo ..... B65H 54/705 242/128
7,552,580 B2 * 6/2009 Xu ..... D01H 1/02 57/282
2001/0003324 A1 * 6/2001 Blankenhorn ..... B29D 29/06 198/844.1

(Continued)

*Primary Examiner* — Shaun R Hurley

(57) ABSTRACT

A method for ring-spinning with pneumatic guiding and capturing includes steps of: respectively fixing a pneumatic guiding and capturing apparatus in front of each drawing system of a ring frame; twisting the ribbon-like strand outputted through a front roller nip to form a spinning strand, moving the spinning strand into a holder groove of a capturing holder; guiding ribbon-like strand edge fibers to closely contact with a spinning strand main body by negative pressure airflow in the holder groove; before the ribbon-like strand edge fibers enter an in-take opening, cohering the edge fibers with the spinning strand for being partly captured by the spinning strand stem; other un-captured edge fibers become spinning strand hairiness, which is then stretched and tightly wrapped onto the spinning strand stem by a negative pressure; the spinning strand is outputted from the holder groove outlet to get a high qualified spun yarn.

20 Claims, 2 Drawing Sheets

(56) References Cited

U.S. PATENT DOCUMENTS

| | | | | |
|---|---|---|---|---|
| 2001/0009052 | A1* | 7/2001 | Stahlecker | D01H 5/72 19/246 |
| 2008/0155786 | A1* | 7/2008 | Xu | D01H 1/02 19/0.27 |
| 2013/0239721 | A1* | 9/2013 | Schneider | D01H 5/72 74/412 R |

* cited by examiner

METHOD AND APPARATUS FOR PNEUMATIC GUIDING AND CAPTURING STRAND FIBERS ON RING FRAME

CROSS REFERENCE OF RELATED APPLICATION

The present invention claims priority under 35 U.S.C. 119(a-d) to CN 201510095954.X, filed Mar. 4, 2015.

BACKGROUND OF THE PRESENT INVENTION

Field of Invention

The present invention relates to a method for ring-spinning, and more particularly to a method and apparatus for pneumatic guiding and capturing strand fibers, wherein a pneumatic apparatus is installed on existing ring frame to improve ring-spun yarn quality, which belongs to a technical field of textiles.

Description of Related Arts

Hairiness is one of the important indexes of yarn quality. Yarn hairiness not only influences efficiency of post-process such as weaving and knitting, but also influences appearance and quality of the final product. Especially, because high-speed shuttleless loom is widely used conventionally, it is quite important to reduce the yarn hairiness.

The yarn hairiness is generated during ring-spinning process. The key problem thereof lies in that: front roller nip presses the fiber strand into a flat shape, and by a twisting torsion force, internal fibers of the flat fiber strand move outwardly. When a certain part of the fiber goes inside the yarn through internal-external migration, the fiber end protruding from the spinning strand is not able to be twisted onto the yarn after being separated from the roller nip, resulting in hairiness. When a fiber is located at the most edge of the flat fiber strand, the cohesion force between the fiber and the spinning strand is weak, and the fiber just moves out of the front roller nip. Under this situation, the fiber is easy to be changed in direction by negative pressure of a pipe, and be separated from the spinning strand. At this time, the fiber is completely separated from the front roller nip and is sucked away by the negative pressure of the pipe, resulting in dropping fiber, and decreasing of fiber utilization as well as ring-spun yarn quality.

To solve the problems of excessive hairiness and poor quality of spun yarn during ring-spinning, scholars over the world have researched a lot. Two methods are mainly used. One is using the conventional method for optimization of conventional ring-spinning process. The method is able to reduce yarn hairiness to some extent, but the effect is limited. The other one is using new spinning technology or special hairiness-eliminating apparatus to eliminate hairiness and drastically improve ring-spinning quality. The new ring-spinning technology or special hairiness-eliminating apparatus is a hot spot of ring-spinning technology. Conventionally, compact spinning technology is a represent of the new ring-spinning technology, such as U.S. patent "Apparatus for stretching, condensing and transporting a rove of fibers during a spinning operation", published in Dec. 18, 1984, U.S. Pat. No. 4,488,379; U.S. patent "Apparatus for condensing a drafted fiber strand", published in Jun. 13, 2000, U.S. Pat. No. 6,073,314; U.S. patent "Arrangement for condensing a drafted fiber strand", published in Jul. 4, 2000, U.S. Pat. No. 6,082,089; U.S. patent "Transport belt for transporting a fiber strand to be condensed", published in Jan. 9, 2001, U.S. Pat. No. 6,170, 126B1; U.S. patent "Arrangement and method for condensing a drafted fiber strand and method for making yarn therefrom", published in Jul. 24, 2001, U.S. Pat. No. 6,263,656B1; U.S. patent "Apparatus for condensing a drafted strand", published in Aug. 14, 2001, U.S. Pat. No. 6,272,834B1; and U.S. patent "Condensing zone for a spinning machine", published in May 29, 2001, U.S. Pat. No. 6,237,317B1. Key principles of the aforementioned patents about compact spinning technology are for ring-spinning, wherein flat ribbon-like fiber strands are condensed to eliminate spinning triangular zone, increase the cohesion force between edge fibers and the spinning strand, strengthen the controlling of the edge fiber of the ribbon-like strand, effectively reduce exposed and escaped fiber ends during spinning, reduce yarn hairiness and fiber loss, and inhibit flyings. However, during eliminating of the spinning triangular zone by compact spinning, fiber migration of the spun yarn inner structure is not enough, and the yarn internal fibers are arranged too straight and compact, resulting in too large stiffness of yarn and serious deterioration of softness. In particular, compact spinning technology using airflow to condense fiber strand requires additional negative pressure vacuum equipments to increase energy consumption, leading to high costs of the compact spinning technology in installation, operation and maintenance, and becoming expensive spinning, which is contrary to the concept of energy saving and low carbon production.

Conventionally, the special hairiness reducing apparatus is air-jet style, and is installed between the front roller nip and the pigtail guider. By additional vortex airflow, the formed hairs are loosely wrapped onto the yarn surface, such as U.S. patent "method and apparatus yarn treatment", published in Apr. 10, 1979, U.S. Pat. No. 4,148,779; and U.S. patent "method and apparatus for modifying spun textile yarn", published in Aug. 22, 1989, U.S. Pat. No. 5,263,311. Main differences between the above patents lay in that due to difference of jet apparatus; force directions on surface fibers of the yarn are different, resulting in different wrapping effects and different hairiness-eliminating effects. However, the apparatus are only able to be installed behind the twisting triangle zone (due to the fibers in twisting triangle area are loose fibrous, and jet flow will lead to confusion motion of the fibers, which will cause end-breakage during spinning), targets of the jet flow are yarn and surface hairiness. Rotating effects on the targets caused by the jet flow are different, for simply fitting or loosely wrapping the hairs onto the yarn surface. As a result, in the subsequent processes (such as winding), all the loosely wrapped hairiness protrudes the yarn surface again due to the mechanical friction pulling fiber ends out of the yarn surface structure, which means that hairiness is not truly eliminated. Furthermore, the above special hairiness reducing apparatus are not able to solve a key problem that strand edge fibers are easy to escape, which forms fiber droppings and flyings.

Chinese patent "Ironing-spinning method for improving yarn properties", published in Jul. 11, 2007, patent number 200610166509.9; and U.S. patent "Method and apparatus for producing high quality yarn on a ring frame", published in Jun. 30, 2009, U.S. Pat. No. 7,552,580B2 both provide ironing-spinning methods for heating the fiber in the spinning triangle zone to improve the yarn quality. However, ironing apparatus of the methods are only applicable to lower fiber modulus for improving fiber torsion and bending performance, and improving yarn surface smoothness as the fibers become soft enough to be spun into the yarn by twisting force during spinning. However, the key problem that edge fibers of the flat ribbon-like fiber strand are easy to escape, which forms fiber droppings and flyings, cannot be solved by this method and apparatus. Furthermore, the ironing apparatus also has extra energy consumption, and has poor effects on the fibers with poor heating sensitivity (such as wool fiber). Therefore, yarn quality is not improved for wool fibers.

SUMMARY OF THE PRESENT INVENTION

According to the above problems, an object of the present invention is to provide a method and apparatus for pneumatic guiding and capturing strand fibers, wherein a pneumatic apparatus is installed on existing ring frame to improve spun yarn quality. Accordingly, in order to accomplish the above object, the present invention provides:

a method for pneumatic guiding and capturing strand fibers, comprising steps of: respectively fixing a pneumatic guiding and capturing apparatus in front of each front roller nip of each drawing system of a ring frame, wherein the pneumatic guiding and capturing apparatus is mounted on a sucking pipe of the ring frame, the pneumatic guiding and capturing apparatus comprises a capturing holder, an air passage communicator, and a movable cover; wherein a holder groove, which is horn-shaped, is provided on the capturing holder, a horn end thereof is an inlet, and an extending end thereof is an outlet; a wind in-taker is provided inside the capturing holder, in-take openings of the wind in-taker are narrow-shaped and are symmetrically arranged on an internal wall of the holder groove; and an axis of a wind in-taker portion near the in-take openings is corresponding to an inlet axis of the holder groove; wherein the air passage communicator comprises a base and a cover installing platform; the base and the cover installing platform are integrated, the cover installing platform is aside the base; a tunnel is provided inside the base, a top end of the base is a concave base; the capturing holder is inserted into the top end of the base; the wind in-taker inside the capturing holder communicates with the tunnel inside the base; a working surface of the capturing holder is parallel to a platform of the cover installing platform, and an axis of the holder groove on the working surface of the capturing holder is parallel to the platform of the cover installing platform; the movable cover is mounted on the platform of the cover installing platform by a hinge; a hinge shaft of the hinge is parallel to the axis of the holder; a bottom end of the base is a pear-shaped buckle mounted on the sucking pipe; and the base communicates with the sucking pipe; wherein after being drafted by the drawing system on the ring spinning machine, the fiber strand is pressed with a shape of flat ribbon to form a ribbon-like fiber strand; the ribbon-like fiber strand is then outputted from the front roller nip to form a spinning strand; the outputted spinning strand is then moving into the capturing holder through the inlet of the holder groove, wherein negative pressure wind of the sucking pipe generates a negative pressure flow inside the holder groove through the tunnel of the base, the wind in-taker of the capturing holder and the in-take openings, for guiding edge fibers of the ribbon-like strand to closely contact with a main body of the spinning strand inputted into the capturing holder; in the capturing holder, before the edge fibers of the ribbon-like strand, which are separated from the front roller nip, enter the in-take opening, cohering the strand edge fibers with hairs on the rotating surface of the spinning strand for being partly captured by the stem of the spinning strand; leaving the rest part of the edge fibers protruding out of the spinning strand surface to form hairiness; wherein when the spinning strand moves to a section of the holder groove corresponding to a position of the in-take opening, the hairiness on the spinning strand surface is stretched by a negative pressure of the in-take opening, so as to closely contact with the wind in-taker and the internal wall of the holder groove; holding the hairiness by friction of the internal wall, and tightly wrapping onto the rotating stem of the spinning strand for fixing the ribbon-like strand edge fibers captured and eliminating the hairiness on the surface of the spinning strand; outputting the spinning strand from the outlet of the holder groove to form a high qualified spun yarn, and finally winding the a high qualified spun yarn onto a yarn bobbin by a pigtail guider, a steel ring and a traveler.

By the above method, compared with conventional technologies, the method and apparatus for pneumatic guiding and capturing strand fibers provided by the present invention have advantages as follows. The present invention respectively fixes the pneumatic guiding and capturing apparatus in front of each front roller nip of each drawing system of the conventional ring frame. The holder groove, which is horn-shaped, is provided on the capturing holder of the pneumatic guiding and capturing apparatus. The wind in-taker is provided inside the capturing holder, and the in-take openings are symmetrically arranged on the internal wall of the holder groove. The wind in-taker of the capturing holder communicates with the sucking pipe through the base of the air passage communicator, so as to generate the negative pressure in the holder groove. Compared with compact spinning and ironing spinning, the method needs no additional sucking or heating energy consumption, which saves production costs. The movable cover is movably mounted on the cover installing platform, which enables that the movable cover covers the working surface of the capturing holder not only during jointing of ring-spinning but also during normal spinning, so as to ensure that during normal spinning, negative pressure airflow only enters from the inlet of the holder groove. Meanwhile, the axis of the wind in-taker portion near the in-take openings is corresponding to the inlet axis of the holder groove, in such a manner that a sucking direction of the negative pressure airflow is aimed at the front roller nip. Therefore, the edge fibers of the ribbon-like strand are guided, which forces the edge fibers to closely contact with the spinning strand stem. Before the strand edge fibers, which are separated from the front roller nip, enters the in-take opening, the strand edge fibers are cohered with hairiness on the rotating surface of the spinning strand, which captures edge fibers escaped from the front roller nip, so as to increase fiber utilization, enhance yarn strength, improve yarn quality, and specially solve the key problem that during utilization of conventional ring-spinning technology, ironing spinning technology and airflow jet hairiness-eliminating apparatus: ribbon-like strand edge fibers are easy to escape to form fiber droppings and flyings. In particular, the hairiness on the surface of the yarn strand is stretched by the negative pressure of the in-take opening, so as to closely contact with the wind in-taker and the internal wall of the holder groove and be held by the internal wall with friction, in such a manner that the hairiness is tightly wrapped on the rotating stem of the spinning strand for fixing the fibers captured and eliminating the hairiness on the surface of the spinning strand main body, which further increases fiber utilization, enhances yarn strength, improves yarn quality, and specially solves the technical defect that airflow jet hairiness-eliminating apparatus only simply fits or loosely wraps the hairiness on the surface of the yarn, and hairiness comes out of yarn stem again because of friction generated during the subsequent processes. The pneumatic guiding and capturing apparatus of the present invention has a reasonable structure and is easy to operate, which is conducive to wide application.

These and other objectives, features, and advantages of the present invention will become apparent from the following detailed description, the accompanying drawings, and the appended claims.

DETAILED DESCRIPTION OF THE PREFERRED EMBODIMENT

Figure 1:
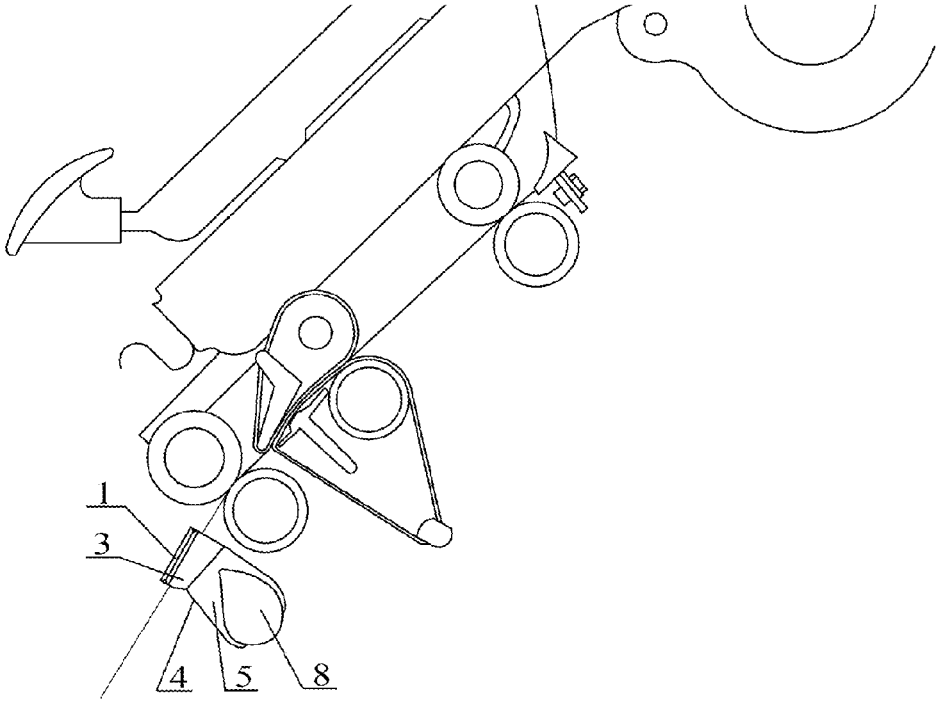
FIG. 1 is a schematic diagram showing the working principle of the present invention.
Figure 2:
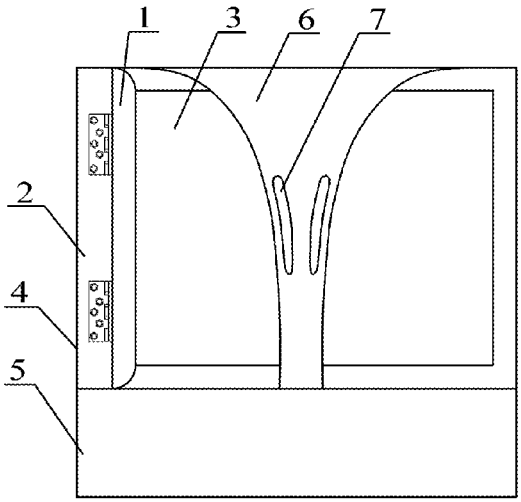
FIG. 2 is a structural diagram of a negative guiding and capturing apparatus of the present invention.
Figure 3:
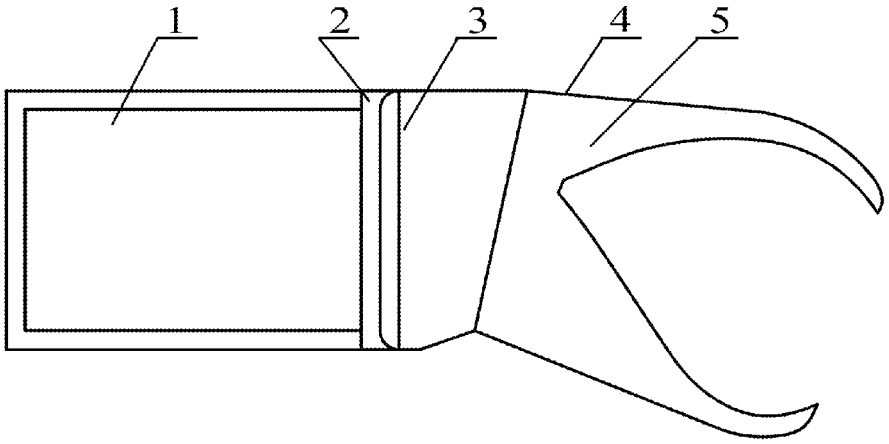
FIG. 3 is a side view of FIG. 2.

Referring to the drawings, the present invention is further illustrated.

A method for pneumatic guiding and capturing strand fibers comprises steps of: respectively fixing a pneumatic guiding and capturing apparatus in front of each front roller nip of each drawing system of a ring frame, wherein the pneumatic guiding and capturing apparatus are mounted on sucking pipes 8 of the ring frame, the pneumatic guiding and capturing apparatus comprises a capturing holder 3, an air passage communicator 4, and a movable cover 1; wherein a holder groove 6, which is horn-shaped, is provided on the capturing holder 3, a horn end of the holder groove 6 is an inlet, and an extending end thereof is an outlet; a wind in-taker is provided inside the capturing holder 3, in-take openings 7 of the wind in-taker are narrow-shaped, a width thereof is no less than 1.5 mm and a length thereof is no less than 4 mm; the in-take openings 7 are symmetrically arranged on an internal wall of the holder groove 6, and a ratio of a width of the holder groove 6 near the in-take openings 7 and an outlet width of the holder groove 6 is 1.1-3.0; and an axis of a wind in-taker portion near the in-take openings 7 is corresponding to an inlet axis of the holder groove 6; wherein the air passage communicator 4 comprises a base 5 and a cover installing platform 2; the base 5 and the cover installing platform 2 are integrated, the cover installing platform 2 is aside the base 5; a tunnel is provided inside the base 5, a top end of the base 5 is a concave base; the capturing holder 3 is inserted into the top end of the base 5; the wind in-taker inside the capturing holder 3 communicates with the tunnel inside the base 5; a working surface of the capturing holder 3 is parallel to a platform of the cover installing platform 2, and an axis of the holder groove 6 on the working surface of the capturing holder 3 is parallel to the platform of the cover installing platform 2; the movable cover 1 is mounted on the platform of the cover installing platform 2 by a hinge; a hinge shaft of the hinge is parallel to the axis of the holder 6, wherein the movable cover 1 is movably mounted on the cover installing platform 2 by the hinge, which is conducive to moving the yarn into the holder groove 6 through an internal between the movable cover 1 and the capturing holder 3, and enables that the movable cover 1 covers the working surface of the capturing holder 3 during normal spinning, so as to avoid that the negative pressure airflow enters the holder groove 6 from a top, and ensure that during normal spinning, negative pressure airflow only enters from the inlet of the holder groove 6; a bottom end of the base 5 is a pear-shaped buckle mounted on the sucking pipe 8; and the base 5 communicates with the sucking pipe 8; wherein after being drafted by the drawing system, the fiber strand is pressed as a ribbon-like fiber strand; outputting the ribbon-like fiber strand through the front roller nip of the ring frame, twisting the ribbon-like fiber strand outputted for forming a spinning strand, moving the spinning strand into the capturing holder 3 through the inlet of the holder groove 6, wherein negative pressure wind of the sucking pipe 8 generates a negative pressure flow inside the holder groove 6 through the tunnel of the base 5, the wind in-taker of the capturing holder 3 and the in-take openings 7, for guiding edge fibers of the ribbon-like strand to closely contact with a main body of the spinning strand inputted into the capturing holder 3; in the capturing holder 3, before the ribbon-like strand edge fibers, which are separated from the front roller nip, enters the in-take opening 7, cohering the ribbon-like strand edge fibers with hairiness on the rotating surface of the spinning strand for being captured by the spinning strand stem; leaving the rest part of the edge fibers protruding out of the spinning strand surface to form hairiness; wherein when the spinning strand moves to a section of the holder groove 6 corresponding to a position of the in-take opening 7, the hairiness on the spinning strand surface is stretched by a negative pressure of the in-take opening 7, so as to closely contact with the wind in-taker and the internal wall of the holder groove 6; holding the hairiness by friction of the internal wall, and tightly wrapping onto the rotating stem of the spinning strand for fixing the ribbon-like strand edge fibers captured and eliminating the hairiness on the surface of the spinning strand. If the ratio of the width of the holder groove 6 near the in-take openings 7 and an outlet width of the holder groove 6 is getting smaller, the in-take opening 7 is getting closer to the outlet, and a capturing effect caused by guiding the edge fibers to closely contact with the yarn body with the negative pressure is getting smaller, but a wrapping effect caused by holding the hairiness with the negative pressure is getting larger. Therefore, for spinning techniques whose width of ribbon-like fiber strand is large and whose yarn is thick, the ratio should be large; otherwise, the ratio should be small. The spinning strand is outputted to form a high qualified spun yarn from the outlet of the holder groove 6, and finally wound on a yarn bobbin by a pigtail guider, a steel ring and a traveler.

Referring to different ring-spinning practices, preferred embodiments of the present invention are illustrated.

Preferred Embodiment 1

Improve Product Quality of Ring-Spinning During Cotton-Fiber Siro Spinning.

For a cotton ring frame, the pneumatic guiding and capturing apparatus is mounted on the sucking pipe 8 whose cross-section is pear-shaped through the base 5, and connects the sucking pipe 8 to the wind in-taker inside the capturing holder 3, for generating the negative pressure airflow in the holder groove 6 with the in-take openings 7. Two cotton rovings enter a drawing system of the cotton ring frame respectively through two 4-mm horn-shaped opening feeders. After being drafted by the drawing system, the cotton rovings are outputted from a front roller nip outlet comprising a front rubber roller and a front roller to form ribbon-like strands. The ribbon-like cotton strands outputted are twisted together for forming a spinning strand, and are immediately inputted into the holder groove 6 of the capturing holder 3. The ratio of the width of the holder groove 6 near the in-take openings 7 and the outlet width of the holder groove 6 is 1.5-2.0. The negative pressure airflow in the holder groove 6 guides a left ribbon-like cotton strand edge fiber and a right ribbon-like cotton strand edge fiber to closely contact with the spinning strand. Before the strand edge fibers, which are separated from the front roller nip, enter the in-take opening 7, the strand edge fibers are cohered with the hairiness on the rotating surface of the spinning strand, which captures strand edge fibers escaped from the front roller nip. When the spinning strand moves to a section of the holder groove 6 corresponding to the position of the in-take opening 7, the hairiness on the surface of the spinning strand is stretched by the negative pressure of the in-take opening 7, so as to closely contact with an internal wall of the wind in-taker and the internal wall of the holder groove 6 and be held by the wind in-taker and the internal wall of the holder groove 6 with friction. The hairiness is tightly wrapped on the rotating stem of the spinning strand for fixing the cotton fibers captured and eliminating the hairiness on the surface of the spinning strand main body. The spinning strand is outputted to form a high qualified cotton bobbin yarn from the outlet of the holder groove 6, and finally wound on a yarn bobbin by a pigtail guider, a steel ring and a traveler. According to experimental results, compared with conventional ring-spun cotton yarn, 30 Ne cotton bobbin yarn prepared by the present invention is improved in that 3 mm hairiness index is decreased by 70%, gram-weight per 100 m is increased by 3.1%, and yarn strength is increased by 4.9%. Thereof, product quality is significantly improved.

Preferred Embodiment 2

Improve Product Quality of Ring-Spinning During Wool Siro Core-Spun Composite Spinning.

For a worsted ring frame, a wool one-pipe-per-spindle sucking pipe system is replaced by the sucking pipe 8 whose cross-section is pear-shaped. The pneumatic guiding and capturing apparatus is mounted on the sucking pipe 8 through the base 5, and connects the sucking pipe 8 to the wind in-taker inside the capturing holder 3. Two wool rovings enter a drawing system of the wool ring frame respectively through two 6-mm horn-shaped opening feeders. After being drafted by the drawing system, the wool rovings are outputted to form ribbon-like strands from a front roller nip outlet comprising a front rubber roller and a front roller, and a polyester filament unwound from filament package passes through a guilder and is outputted from a rear of the front rubber roller by the front roller. The polyester filament is placed between the two wool rovings, and is twisted together with the two ribbon-like strands outputted for forming a composite spinning strand, and are immediately inputted into the holder groove 6 of the capturing holder 3. The ratio of the width of the holder groove 6 near the in-take openings 7 and the outlet width of the holder groove 6 is 2.0-3.0. The negative pressure airflow in the holder 6 guides a left ribbon-like wool strand edge fiber and a right ribbon-like wool strand edge fiber to closely contact with the composite spinning strand stem. Before the wool strand edge fibers, which are separated from the front roller nip, enter the in-take opening 7, the ribbon-like cotton strand edge fibers are cohered with the hairiness on the rotating surface of the composite spinning strand, which captures strand fibers escaped from the front roller nip. When the composite spinning strand moves to a section of the holder groove 6 corresponding to the position of the in-take opening 7, the hairiness on the surface of the composite spinning strand is stretched by the negative pressure of the in-take opening 7, so as to closely contact with an internal wall of the wind in-taker and the internal wall of the holder groove 6 and be held by the wind in-taker and the internal wall of the holder groove 6 with friction. The hairiness is tightly wound on the rotating stem of the composite spinning strand for fixing the wool fibers captured and eliminating the hairiness on the surface of the composite spinning strand main body. The composite spinnin strand is outputted to form a high qualified worsted composite bobbin yarn from the outlet of the holder groove 6, and finally wound on a yarn bobbin by a pigtail guider, a steel ring and a traveler. According to experimental results, compared with conventional ring-spun worsted composite yarn, 20 Nm worsted composite bobbin yarn prepared by the present invention is improved in that 3 mm hairiness index is decreased by 64%, gram-weight per 100 m is increased by 3.3%, and yarn strength is increased by 5.4%. Thereof, product quality is significantly improved.

Preferred Embodiment 3

Improve Product Quality of Ring-Spinning During Long Staple Ramie Spinning.

For a ramie long fiber ring frame, a long staple ramie one-pipe-per-spindle sucking pipe system is replaced by the sucking pipe 8 whose cross-section is pear-shaped. The pneumatic guiding and capturing apparatus is mounted on the sucking pipe 8 through the base 5, and connects the sucking pipe 8 to the wind in-taker inside the capturing holder 3. A long staple ramie roving enters a drawing system of the long staple ramie ring frame a horn-shaped opening feeder. After being drafted by the drawing system, the ramie roving is outputted to form a ribbon-like strand from a front roller nip outlet comprising a front rubber roller and a front roller. The ribbon-like strand outputted is twisting for forming a spinning strand, and is immediately inputted into the holder groove 6 of the capturing holder 3. The ratio of the width of the holder groove 6 near the in-take openings 7 and the outlet width of the holder groove 6 is 1.1-1.5. The negative pressure airflow in the holder groove 6 guides a left ribbon-like ramie strand edge fiber and a right ribbon-like ramie strand edge fiber to closely contact with the spinning strand stem. Before the edge ramie fibers, which is separated from the front roller nip, enters the in-take opening 7, the strand edge fibers are engaged with the hairiness on the rotating surface of the spinning strand, which captures the edge fibers escaped from the front roller nip. When the spinning strand moves to a section of the holder groove 6 corresponding to the position of the in-take opening 7, the hairiness on the surface of the spinning strand is stretched by the negative pressure of the in-take opening 7, so as to closely contact with an internal wall of the wind in-taker and the internal wall of the holder groove 6 and be held by the wind in-taker and the internal wall of the holder groove 6 with friction. The hairiness is tightly wound on the rotating stem of the spinning strand for fixing the ramie fibers captured and eliminating the hairiness on the surface of the spinning strand main body. The spinning strand is outputted to form a high qualified ramie bobbin yarn from the outlet of the holder groove 6, and finally wound on a yarn tube by a pigtail guider, a steel ring and a traveler. According to experimental results, compared with conventional ring-spun ramie yarn, 38 Nm ramie bobbin yarn prepared by the present invention is improved in that 3 mm hairiness index is decreased by 57%, gram-weight per 100 m is increased by 2.1%, and yarn strength is increased by 4.7%. Thereof, product quality is significantly improved.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for pneumatic guiding and capturing strand fibers, comprising steps of: respectively fixing a pneumatic guiding and capturing apparatus in front of each front roller nip of each drawing system of a ring frame, wherein the pneumatic guiding and capturing apparatus is mounted on sucking pipes (8) of the ring frame, the pneumatic guiding and capturing apparatus comprises a capturing holder (3), an air passage communicator (4), and a movable cover (1); wherein a holder groove (6) is provided on the capturing holder (3), a horn end thereof is an inlet, and an extending end thereof is an outlet; a wind in-taker is provided inside the capturing holder (3), in-take openings (7) of the wind in-taker are narrow-shaped and are symmetrically arranged on an internal wall of the holder groove (6); and an axis of a wind in-taker portion near the in-take openings (7) is corresponding to an inlet axis of the holder groove (6); wherein the air passage communicator (4) comprises a base (5) and a cover installing platform (2); the base (5) and the cover installing platform (2) are integrated, the cover installing platform (2) is aside the base (5); a tunnel is provided inside the base (5), a top end of the base (5) is a concave base; the capturing holder (3) is inserted into the top end of the base (5); the wind in-taker inside the capturing holder (3) communicates with the tunnel inside the base (5); the movable cover (1) is mounted on the platform of the cover installing platform (2) by a hinge; a hinge shaft of the hinge is parallel to the axis of the holder (6); and the base (5) communicates with the sucking pipe (8); wherein after being drafted by the drawing system on the ring spinning machine, the fiber strand is pressed with a shape of flat ribbon to form a ribbon-like fiber strand; the ribbon-like fiber strand is then outputted from the front roller nip to form a spinning strand; the outputted spinning strand is then moved into the capturing holder (3) through the inlet of the holder groove (6), wherein negative pressure wind of the sucking pipe (8) generates a negative pressure flow inside the holder groove (6) through the tunnel of the base (5), the wind in-taker of the capturing holder (3) and the in-take openings (7), for guiding edge fibers of the ribbon-like strand to closely contact with a main body of the spinning strand inputted into the capturing holder (3); in the capturing holder (3), before the edge fibers of the ribbon-like strand, which are separated from the front roller nip, enter the in-take opening (7), cohering the strand edge fibers with hairs on the rotating surface of the spinning strand for being partly captured by the stem of the spinning strand; leaving the rest part of the edge fibers protruding out of the spinning strand surface to form hairiness; wherein when the spinning strand moves to a section of the holder groove (6) corresponding to a position of the in-take opening (7), the hairiness on the spinning strand surface is stretched by a negative pressure of the in-take opening (7), so as to closely contact with the wind in-taker and the internal wall of the holder groove (6); holding the hairiness by friction of the internal wall, and tightly wrapping onto the rotating stem of the spinning strand for fixing the ribbon-like strand edge fibers captured and eliminating the hairiness on the surface of the spinning strand; outputting the spinning strand from the outlet of the holder groove (6) to form a spun yarn, and finally winding the spun yarn onto a yarn bobbin by a pigtail guider, a steel ring and a traveler.

2. The method, as recited in claim 1, wherein a working surface of the capturing holder (3) is parallel to a platform of the cover installing platform (2), and an axis of the holder groove (6) on the working surface of the capturing holder (3) is parallel to the platform of the cover installing platform (2).

3. The method, as recited in claim 1, wherein a bottom end of the base (5) is a buckle mounted on the sucking pipe (8).

4. The method, as recited in claim 2, wherein a bottom end of the base (5) is a buckle mounted on the sucking pipe (8).

5. The method, as recited in claim 2, wherein a width of the in-take opening (7) is no less than 1.5 mm, and a length thereof is no less than 4 mm.

6. The method, as recited in claim 3, wherein a width of the in-take opening (7) is no less than 1.5 mm, and a length thereof is no less than 4 mm.

7. The method, as recited in claim 4, wherein a width of the in-take opening (7) is no less than 1.5 mm, and a length thereof is no less than 4 mm.

8. The method, as recited in claim 2, wherein a ratio of a width of the holder groove (6) near the in-take openings (7) and an outlet width of the holder groove (6) is 1.1-3.0.

9. The method, as recited in claim 3, wherein a ratio of a width of the holder groove (6) near the in-take openings (7) and an outlet width of the holder groove (6) is 1.1-3.0.

10. The method, as recited in claim 4, wherein a ratio of a width of the holder groove (6) near the in-take openings (7) and an outlet width of the holder groove (6) is 1.1-3.0.

11. An apparatus for pneumatic guiding and capturing strand fibers, comprising a pneumatic guiding and capturing apparatus, respectively fixed in front of each front roller nip of each drawing system of a ring frame, wherein the pneumatic guiding and capturing apparatus is mounted on sucking pipes (8) of the ring frame, the pneumatic guiding and capturing apparatus comprises a capturing holder (3), an air passage communicator (4), and a movable cover (1); wherein a holder groove (6) is provided on the capturing holder (3), a horn end thereof is an inlet, and an extending end thereof is an outlet; a wind in-taker is provided inside the capturing holder (3), in-take openings (7) of the wind in-taker are narrow-shaped and are symmetrically arranged on an internal wall of the holder groove (6); and an axis of a wind in-taker portion near the in-take openings (7) is corresponding to an inlet axis of the holder groove (6); wherein the air passage communicator (4) comprises a base (5) and a cover installing platform (2); the base (5) and the cover installing platform (2) are integrated, the cover installing platform (2) is aside the base (5); a tunnel is provided inside the base (5), a top end of the base (5) is a concave base; the capturing holder (3) is inserted into the top end of the base (5); the wind in-taker inside the capturing holder (3) communicates with the tunnel inside the base (5); the movable cover (1) is mounted on the platform of the cover installing platform (2) by a hinge; a hinge shaft of the hinge is parallel to the axis of the holder (6); and the base (5) communicates with the sucking pipe (8); wherein after being drafted by the drawing system on the ring spinning machine, the fiber strand is pressed with a shape of flat ribbon to form a ribbon-like fiber strand; the ribbon-like fiber strand is then outputted from the front roller nip to form a spinning strand; the outputted spinning strand is then moved into the capturing holder (3) through the inlet of the holder groove (6), wherein negative pressure wind of the sucking pipe (8) generates a negative pressure flow inside the holder groove (6) through the tunnel of the base (5), the wind in-taker of the capturing holder (3) and the in-take openings (7), for guiding edge fibers of the ribbon-like strand to closely contact with a main body of the spinning strand inputted into the capturing holder (3).

12. The apparatus, as recited in claim 11, wherein a working surface of the capturing holder (3) is parallel to a platform of the cover installing platform (2), and an axis of the holder groove (6) on the working surface of the capturing holder (3) is parallel to the platform of the cover installing platform (2).

13. The apparatus, as recited in claim 11, wherein a bottom end of the base (5) is a buckle mounted on the sucking pipe (8).

14. The apparatus, as recited in claim 12, wherein a bottom end of the base (5) is a buckle mounted on the sucking pipe (8).

15. The apparatus, as recited in claim 12, wherein a width of the in-take opening (7) is no less than 1.5 mm, and a length thereof is no less than 4 mm.

16. The apparatus, as recited in claim 13, wherein a width of the in-take opening (7) is no less than 1.5 mm, and a length thereof is no less than 4 mm.

17. The apparatus, as recited in claim 14, wherein a width of the in-take opening (7) is no less than 1.5 mm, and a length thereof is no less than 4 mm.

18. The apparatus, as recited in claim 12, wherein a ratio of a width of the holder groove (6) near the in-take openings (7) and an outlet width of the holder groove (6) is 1.1-3.0.

19. The apparatus, as recited in claim 13, wherein a ratio of a width of the holder groove (6) near the in-take openings (7) and an outlet width of the holder groove (6) is 1.1-3.0.

20. The apparatus, as recited in claim 14, wherein a ratio of a width of the holder groove (6) near the in-take openings (7) and an outlet width of the holder groove (6) is 1.1-3.0.

* * * * *